United States Patent [19]

Jaeger

[11] Patent Number: 4,720,058

[45] Date of Patent: Jan. 19, 1988

[54] METHOD FOR TRACKING A MOTOR-OPERATED FLYING OBJECT

[75] Inventor: Walter Jaeger, Cureglia, Switzerland

[73] Assignee: GX-Holding AG, Basel, Switzerland

[21] Appl. No.: 867,612

[22] PCT Filed: Aug. 12, 1983

[86] PCT No.: PCT/CH83/00097

§ 371 Date: Apr. 17, 1984

§ 102(e) Date: Apr. 17, 1984

[87] PCT Pub. No.: WO84/00806

PCT Pub. Date: Mar. 1, 1984

Related U.S. Application Data

[63] Continuation-in-part of Ser. No. 601,366, Apr. 17, 1984, abandoned.

[30] Foreign Application Priority Data

Aug. 20, 1982 [CH] Switzerland ..... 4974/82
Sep. 2, 1982 [CH] Switzerland ..... 5221/82

[51] Int. Cl.[4] ..... F41G 7/22

[52] U.S. Cl. ..... 244/3.15; 89/1.11

[58] Field of Search ..... 244/3.15, 3.16, 3.13, 244/3.21; 89/1.11

[56] References Cited

U.S. PATENT DOCUMENTS

| | | | |
|---|---|---|---|
| 2,922,600 | 1/1960 | Craft | 244/3.21 |
| 3,219,292 | 11/1965 | Chubb | 244/3.15 |
| 3,276,725 | 10/1966 | Bennett | 244/3.15 |
| 3,900,175 | 8/1975 | Eckerstrom et al. | 244/3.13 |
| 4,170,330 | 10/1979 | Hertzberg et al. | 244/3.13 |
| 4,193,688 | 3/1980 | Watkins | 244/3.16 |
| 4,383,663 | 5/1983 | Nichols | 244/3.16 |

*Primary Examiner*—Charles T. Jordan
*Attorney, Agent, or Firm*—Eric P. Schellin

[57] ABSTRACT

A method of tracking a motor driven flying object by means of a steerable tracker body wherein the tracker body is introduced into the trail of the flying object and at least one part of the tracker body is steered in accordance with combustion products generated by the motor of the flying object or reduced ion mobility as criteria in order to fly along the trail.

13 Claims, 6 Drawing Figures

METHOD FOR TRACKING A MOTOR-OPERATED FLYING OBJECT

Figure 1:
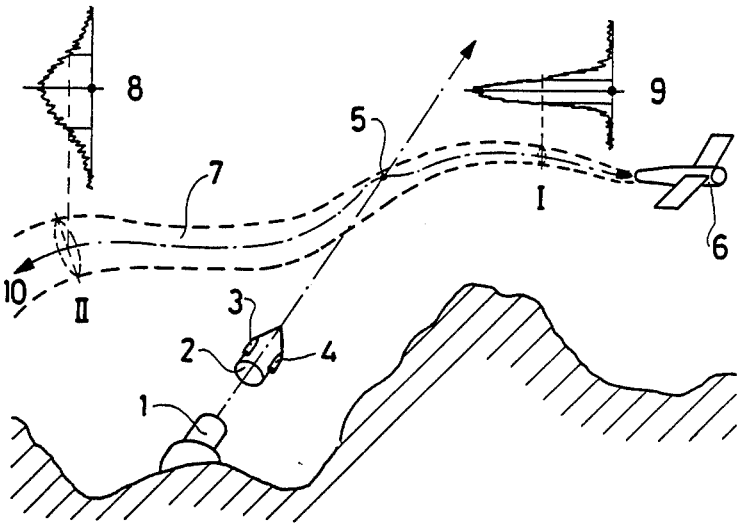

This application is a continuation-in-part of application Ser. No. 601,366, filed Apr. 17, 1984, now abandoned.

The invention consists of a method of tracking a motor driven flying object by means of a steerable tracker body.

The defense against airplanes is known to consist of artillery which is shot to the crossing point based on a predicted flight path and considering the flight time of the missile. This method is not effective if the airplane has an irregulara flight path and can therefore not be hit.

If the flight path of the aircraft to be shot is not regular it is preferable to use a steerable flying object, which is constantly directed to the object to be hit. This method fails, however, if i.e. the object to be hit disappears behind a geographical obstacle.

Therefore, both methods fail during low flying attacks. These methods and all other previously known methods can not reveal the location of the takeoff point, i.e. of a carrier from which the aircraft started its irregular flight path. It is desirable to know this location.

The present invention provides a method of tracking a motor driven flying object in which the above mentioned disadvantages are overcome and which permits location of low flying objects as well as take-off locations without visual contact.

This problem can be solved by a method of the above mentioned invention that induces the tracking device into the path of the aircraft and by directing at least part of it depending on certain path criteria so that it or they flies or fly along this path. The path to be followed can be followed from outside with the help of observation.

However, it is also possible to direct the tracking device or parts of it so that it or they flies or fly inside the path to be followed; that is on a direct tracking path.

The method of the invention allows on the one hand to track the flying object and on the other hand it enables to hit the take-off point of the aircraft producing the path by directing the tracking device or parts of it into the opposite direction of the aircraft along its path.

The criteria in the path produced by the motorized flying object are advantageously used in the directly or indirectly heated air and/or other resulting physical changes in the air, especially reduced mobility of ions and/or combustion results.

It is sometimes advantageous if foreign enemy aircrafts can be diffrenciated by the tracking device. An agent is mixed into the exhaust gases of the foreign aircraft's engine and identified by the tracking device. The path criteria are constantly weakened by influence of diffusion, and as the path followed can be twisted in three dimensions, it is advantageous, if at least 3 path sensors are being used, which are at right angles to the flight direction of the tracking device or parts of it and which use the gradient of concentration in the track criterion to direct the tracking device or parts of it by giving flight direction signals.

To prevent the need of additional track sensors it is advantageous if the tracking device or at least part of it at least after being induced into the path of the aircraft continue(s) a screw-like flight path with a prefixed rotation time around the axis of the path and if the flight path of the tracking device or a part of it is being corrected so that the average flight direction of the tracking device or a part of it is at least approximately identical to the axis of the path.

For these purposes it is advantageous for the correction of the flight path of the tracking device or one part of it to determine the intensity of the path criteria and to compare them with the intensity determined by the flight path during one rotation time and to derive thereof a signal for correction of the flight path.

The path criteria can be locally disturbed by atmospheric turbulence and it is therefore advantageous to derive the signal for correction of the flight path from a path unit that consists of several rotation times.

For the secure inducing of the tracking device or at least parts of it into the path of the aircraft it is advantageous to determine an average plane that is defined by the taking-off point of the tracking device and two points of the flight path of the aircraft. The tracking device will then be directed towards the flight path of the aircraft on this plane.

It may prove to be advantageous if the tracking device after being induced into the path of the aircraft can be directed to the flight path of the aircraft on the basis of track criteria determined by the tracking device.

It is advantageous if by the help of at least two points of the flight path of the aircraft, the axis of the path of the tracking device can be removed and the tracking device will be induced into a path outside of the aircraft's path.

Figure 2:
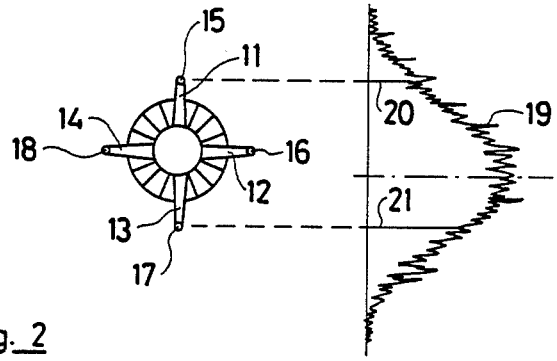
Figure 3:
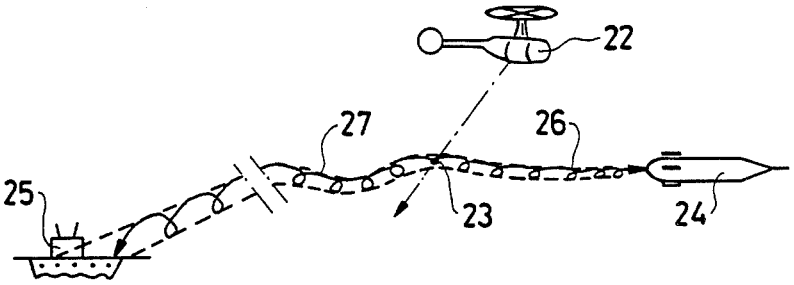

The specifications are explained by the drawings as follows:

FIG. 1. A Schematic application of the invented method;

FIG. 2. A back view of a tracking head's position with a diagram of the track criteria's diverse intensity;

FIG. 3. An additional scheme for an application of the invented method with a screw like path; and FIG. 4. A length view of the tracking path according to FIG. 3.

Figure 5:
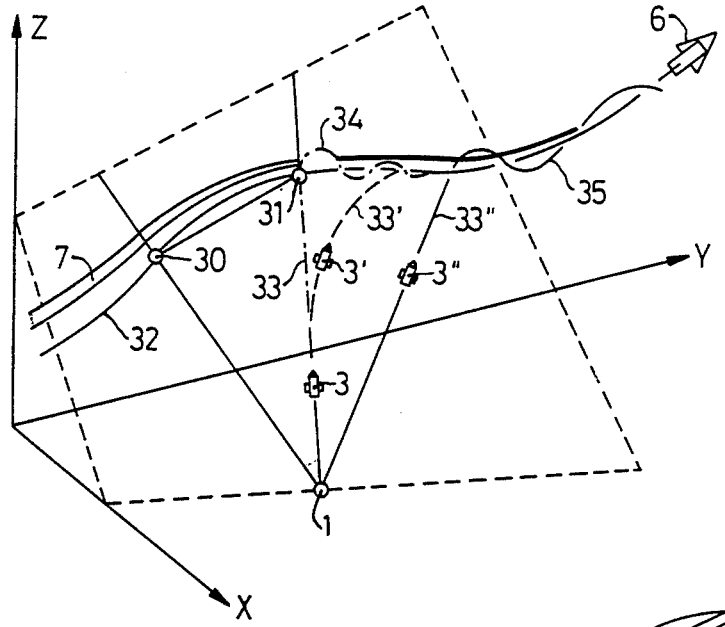

FIG. 5. A third possible scheme of an application of the invented method; and

Figure 6:
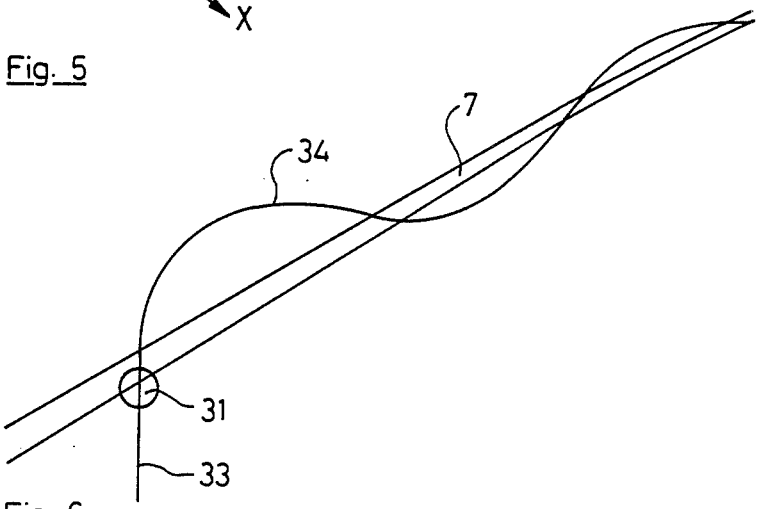

FIG. 6. A magnified example of the inducement of the tracking device into the flight path of the aircraft to be tracked as shown in FIG. 5.

FIG. 1. shows the launching stage 1 of a rocket carrier 2, that includes for example two tracker bodies 3 and 4 and is being shot to point 5. At the time of the take-off the aircraft 6 to be followed is located at point 5. The aircraft has left track 7 behind. Track 7 has at locations I and II a diverse intensity of the path criteria as shown by curves 8 and 9. When rocket carrier 2 passes track 7 at point 5 it releases two tracker bodies 3 and 4, one of which follows the aircraft 6 and the other one flies in the opposite direction to the starting point of the aircraft 6.

As a result it is possible to hit on one side the aircraft 6 and on the other side it's take-off position without need for visual contact between the tracker bodies 3 and 4 and the objects to be hit.

The tracker bodies 3 and 4 carry four steering fins 11, 12, 13 and 14 and each of these four fins carry LIDAR sensors 15, 16, 17 and 18 attached at their exterior sides.

The right side of FIG. 2 shows the intensity criterion 19 as seen in a front veiw of a cut through the path. It has a bell like shape. As a result of the asymetrical position of the tracker bodies 3 respective 4 they receive unequally strong path criteria signals 20, 21. These are being used for repositioning the surfaces 12 and 14.

The turbulent flow of the atmosphere causes the intensity of the path criterion to be unclear. This can be overcome by calculating the average values.

The second example of an application in FIG. 3 shows a helicopter 22 shooting a carrier missile to an enemy missile 24 that is located at takeoff time on position 23. The enemy missile had been fired from an aircraft carrier that can not be seen by the helicopter. The rocket fired from the helicopter 22 releases in position 23 two tracker bodies which follow self-powered along the inside of the path in a screw-like shaped flight path 26 and 27, one follows the missile 24, the other follows in the direction of the aircraft carrier.

Figure 4:
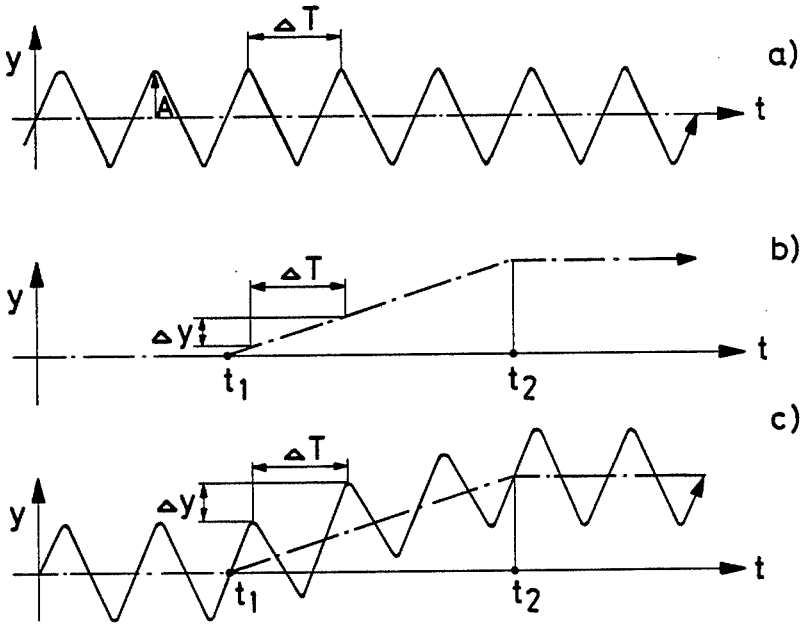

FIG. 4 shows how the tracker bodies applied in FIG. 3 can be directed. t stands for time, y is the vertical component of the sensor's flight path. FIG. 4*a* shows a horizontal view of the screw-like shaped path of a tracker body, as no impact of path criterion on the sensor head. The amplitude of the screw line is A and the time for one complete rotation is $\Delta T$.

FIG. 4*b* points to a perpendicular plane and projects schematically a unit of the path of the aircraft to be tracked. The path of the aircraft to be followed passes $t_1$ and $t_2$ and is continuously increasing in altitude. The elevation of the aircraft's path during above mentioned rotation time $\Delta T$ of the tracking head is $\Delta y$.

FIG. 4*c* points to a perpendicular plane and projects the screw-like shaped path of the tracking head for the same path of the aircraft to be followed as in FIG. 4*b*. For simplification it is assumed that the change in height $\Delta y$ is being corrected instantly and without rotations. This assumption however is not realistic and the path of the tracking head is effected by rotations and phases. This does not essentially influence the working principle of the device.

If an object has to be attached it is possible to replace the rocket carrier and its detachable tracking head by a rocket carrier that is simultaneously a tracking head and follows the path.

The method presented is based on the fact that any engine leaves a track in the air. The accuracy of the method is better if the tracks as represented in FIG. 1 and 2 are distinct. Diffusion and turbulence effects make the track to be less concentrated. If the diffusion is bigger, also the disappearance of the track is faster. It is therefore especially advantageous to rely on the reduced mobility of the ions. This method uses the so called Langevin-Ions that are composed of molecular comlexes consisting of hundreds to thousands of molecules. Accordingly they are of very small mobility and as the laws of Brown's molecule mobility show, they have very little diffusion.

As shown in FIG. 5 it is possible to induce the tracking head 1 into track 7 of the aircraft 6 to be followed by a plane connecting the take-off location of the tracking head 3 and two points 30 and 31 of the flight path 32 of the aircraft 6. For example two consecutive points of the aircraft's 6 tracks are being optically or electronically detected. After its take-off the tracking head 3 is being directed to follow a path 33 on a plane defined by points 1, 30 and 31.

After the tracking head 3 has taken off there are three examples for methods according to FIG. 5 to induce tracking head 3 into track 7 of the aircraft 6 to be followed.

The tracking head 3 in the first method is being shot directly on position 31 on a plane defined by points 1, 30 and 31. The aircraft 6 is being located in position 31 at the time of the tracking head's 3 take-off.

The tracking head 3 crosses at position 31 the flight path 32 of the aircraft 6 to be followed. In a normal case the tracking head 3 also crosses the track 7 of the aircraft 6 or at least it vicinity.

When crossing track 7 the tracking head 3 is being directed to a curved path 34 leading to the track 7. This is caused by path criteria detected by the sensor heads or on the basis of calculations of the flight time on a plane defined by 1, 30, 31.

As shown in FIG. 6 the tracking head 3 is being induced into track 7 via a path oscillating around track 7. Each time when track 7 is being crossed the sensors of the tracking device readjust the path of the tracking device 3 according to the new track elements.

In the second method the tracking device 3' is being induced tangentially via a flight path 33' based on plane 1, 30 and 31 into an outside flight path 32 of the aircraft 6 to be followed. Then it is possible to use a screw-like flight path around track 7.

In the third method the tracking device 3'' is being induced by approaching on the plane 1, 30 and 31 in a screw-like flight path 35 that is outside of the flight path 32 and therefore also outside of track 7. For this method it is advantageous to explode tracking device 3 by an approach ignitor in range of aircraft 6 to be followed.

Normally the track 7 and the flight path 32 of the aircraft are identical. But strong winds, as demonstrated in FIG. 5 can cause a difference in location between track 7 and flight path 32 of the aircraft 6. This does not have any influence on the invented method.

The tracking head 3 is being directed into one or the opposite track direction by choice, depending on whether aircraft 6 or its take-off point, i.e. an aircraft carrier has to be located and hit.

I claim:

1. A method of tracking a motor driven flying object by means of a steerable tracker body in which the tracker body is introduced into a trail of a flying object and at least one part of the tracker body is steered in accordance with combustion products generated by a motor of the flying object as a predetermined trail criterion so as to fly along said trail; said combustion products being remotely sensed by at least one lidar sensor incorporated in said tracker body, said lidar being sensitive to combustion generated molecule complexes and combustion generated aerosoles as trail criterion and being connected with a computer generating steering signals in consequency of signals from said lidar sensor.

2. A method according to claim 1 in which at least one part of the tracker body is steered so as to fly within the trail to be followed.

3. A method according to claim 1 in which at least three sensors are used, said sensors being mounted on at least one part of the tracker body at positions spaced at right angles to the flight direction, and in which a gradient of the concentration of the trail criterion is used to provide flight direction control signals for steering said at least one part of the tracker body.

4. A method according to claim 1 in which said at least one part of the tracker body is made to follow a helical flight path having a predetermined revolution time around the axis of the trail of the flying object, and in which the flight path of a part of said tracker body is controlled so that the average flight path coincides at least approximately with the trail axis.

5. A method according to claim 4 in which, in order to control the flight path of said at least one part of the tracker body, an intensity of the trail criterion is detected and compared with an intensity detected during a revolution of the flight path, the result of the comparison being used to provide a signal for controlling the flight path.

6. A method according to claim 5 in which the signal for controlling the flight path is derived from a section of the flight path which corresponds to a plurality of revolutions of the flight path.

7. A method according to claim 1 in which the tracker body is introduced into the trail of the flying object by determining a plane which passes through the take off point of the tracker body and two points on the flight path of the flying object and directing the tracker body along this plane towards the trail of the flying object.

8. A method according to claim 7 in which, after at least one tracker body has entered the trail of the flying object, at least one part of the tracker body is steered in the direction of the trail of the flying object on the basis of trail criteria determined by at least one part of the tracker body.

9. A method according to claim 7 in which the flight path of the flying object is extrapolated with the aid of at least two points along said flight path and the tracker body is guided into the extrapolated flight path of the flying object.

10. A method according to claim 7 in which the flight path of the flying object is extrapolated with the aid of at least two points along said flight path and said at least one part of the tracker body is guided into a substantially helical flight path about the extrapolated flight path of the flying object, such that the mean flight direction of at least one part of the tracker body coincides at least approximately with the extrapolated flight path of the flying object.

11. A method according to claim 10 in which said at least one part of the tracker body is provided with a proximity fuse.

12. A method according to claim 1 or 11 in which at least one part of the tracker body is steered in the opposite direction of the flying object along the trail produced by the flying object.

13. The method of claim 1 in which the tracker body comprises a carrier rocket and at least one motor driven self steerable tracker head.

* * * * *